US011253985B2

(12) United States Patent
DeGrace et al.

(10) Patent No.: US 11,253,985 B2
(45) Date of Patent: Feb. 22, 2022

(54) CUP PLUG INSERTION TOOL

(71) Applicant: GM Global Technology Operations LLC, Detroit, MI (US)

(72) Inventors: Garrold A. DeGrace, Frankenmuth, MI (US); Gabriel Gonzalez Gillis, Windsor (CA); Patrick M. Hilber, Clarkston, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 106 days.

(21) Appl. No.: 16/853,321

(22) Filed: Apr. 20, 2020

(65) Prior Publication Data

US 2021/0323127 A1 Oct. 21, 2021

(51) Int. Cl.
*B25B 27/02* (2006.01)

(52) U.S. Cl.
CPC ..... *B25B 27/02* (2013.01)

(58) Field of Classification Search
CPC . B25B 27/02; B25B 27/0028; B25B 27/0035; B25B 27/06
USPC ..... 29/244, 280, 283, 278, 255; 269/309, 269/310; 279/2.02; 81/15.9
See application file for complete search history.

(56) References Cited

U.S. PATENT DOCUMENTS

| | | | | |
|---|---|---|---|---|
| 7,993,368 | B2 * | 8/2011 | Gambale | A61B 17/0487 606/232 |
| 9,801,667 | B2 * | 10/2017 | Hawkes | A61B 17/7082 |
| 2008/0269768 | A1 * | 10/2008 | Schwager | A61B 17/8888 606/104 |
| 2013/0074657 | A1 * | 3/2013 | Bishop | B25B 23/101 81/53.1 |

* cited by examiner

*Primary Examiner* — Lee D Wilson
*Assistant Examiner* — Robert F Neibaur

(57) ABSTRACT

A cup plug insertion tool comprises a cylindrical base and a cylindrical collet extending from the base and including at least two longitudinal slots that divide the collet into at least two flexible segments adapted to flex radially inward under force, an annular groove formed adjacent the base, the annular groove adapted to allow the flexible segments to flex radially inward, further wherein, the force necessary to flex the flexible segments radially inward is tunable based on a width and depth of the annular groove, a first section defining a circumferential outer diameter and a circumferential inner diameter, a second section defining a circumferential outer diameter that is larger than the circumferential outer diameter of the first section, a tip positioned at the distal end of the collet, and a chamfer formed between the outer diameter of the first section and the tip.

18 Claims, 4 Drawing Sheets

CUP PLUG INSERTION TOOL

INTRODUCTION

The present disclosure relates to a tool for inserting cup plugs in automotive applications. Current cup plug press operations suffer a high incidence of sporadic failures during post operation leak test. The failures are frequently associated and appear physically correlated to excessive press force upon insertion.

One known tool features significant relief between the outer diameter of the tool and the inner diameter of the cup plug. In this arrangement, the centering is completely dependent upon the presentation of the cup plug to the tool and upon the vacuum and friction with which the cup plug is held against the tool. Significant droop, where the plug moves or falls with gravity downward to contact the top of the tool outer diameter may occur. This droop creates a gouging effect near the bottom of the bore during press, increasing the likelihood of a leaking joint. Another known tool utilizes a much tighter tolerance between the outer diameter of the tool and the inner diameter of the cup plug. This tool also pushes against the back of the cup plug, rather than the forward cup surface. An interference fit between the outer diameter of the tool and the inner diameter of the cup plug centers the cup plug effectively, but occasionally results in the cup plug deforming and tightly grabbling the tool. If there is too much friction between the outer diameter of the tool and the inner diameter of the cup plug, the cup plug may remain on the tool and get pulled out upon tool retraction.

Thus, while current cup plug insertion tools achieve their intended purpose, there is a need for a new and improved cup plug insertion tool that ensures the cup plug is centered upon insertion without the risk of the cup plug being pulled out by the tool upon retraction.

SUMMARY

According to several aspects of the present disclosure, a cup plug insertion tool comprises a cylindrical base and a cylindrical collet extending from the base and including a plurality of longitudinal slots that divide the collet into a plurality of flexible segments, the collet including a first section defining a circumferential outer diameter and a circumferential inner diameter, wherein the circumferential outer diameter of the first section is adapted to engage a cup plug to removeably secure the cup plug onto a distal end of the collet when the cup plug insertion tool is used to press the cup plug into a bore.

According to another aspect, the flexible segments are adapted to flex radially inward under force, thereby reducing the outer diameter of the first section of the collet.

According to another aspect, the cup plug insertion tool is adapted to insert a cup plug having an inner diameter that is smaller than the circumferential outer diameter of the first section of the collet, such that when the cup plug is placed onto the distal end of the collet the flexible segments are adapted to flex radially inward, reducing the outer diameter of the first section and allowing the distal end of the collet to fit within the inner diameter of the cup plug.

According to another aspect, the flexible segments are biased to an un-flexed position, and when a cup plug is placed onto the distal end of the collet, the flexible segments push radially outward to frictionally engage the inner diameter of the cup plug and hold the cup plug thereon.

According to another aspect, the distal end of the collet is adapted to position the cup plug co-axially with a central axis of the cup plug insertion tool.

According to another aspect, each of the flexible segments are equally biased such that a cup plug placed on the distal end of the collet is automatically centered co-axially with the central axis of the cup plug insertion tool.

According to another aspect, the biasing force of the flexible segments is adapted to provide frictional engagement to secure a cup plug on the distal end of the collet and to allow free release of the cup plug insertion tool from the cup plug after the cup plug has been inserted.

According to another aspect, the distal end of the collet includes a tip adapted to engage a disk portion of a cup plug that is placed thereon, and a chamfer between the outer diameter of the first section and the tip, the chamfer adapted to prevent the distal end of the collet from contacting an annular radius of the cup plug.

According to another aspect, the collet includes a second section having a cylindrical outer diameter that is larger than the cylindrical outer diameter of the first section.

According to another aspect, the collet includes an annular groove formed adjacent the base, the annular groove adapted to allow the flexible segments to flex radially inward.

According to another aspect, the force necessary to flex the flexible segments radially inward is tunable based on a width and depth of the annular groove.

According to another aspect, the inner diameter of the collet is adapted to support a vacuum tube, the vacuum tube adapted to engage a cup plug to provide additional force to secure the cup plug onto the distal end of the collet.

According to another aspect, the cup plug insertion tool is made from a metallic material.

According to another aspect, the cup plug insertion tool is made from one of steel and aluminum.

According to another aspect, the collet includes at least two longitudinal slots defining at least two flexible segments.

According to another aspect, the collet includes six longitudinal slots defining six flexible segments.

According to several aspects of the present disclosure, a cup plug insertion tool comprises a cylindrical base, a cylindrical collet extending from the base and including at least two longitudinal slots that divide the collet into at least two flexible segments, the flexible segments adapted to flex radially inward under force, and a first section defining a circumferential outer diameter and a circumferential inner diameter, the cup plug insertion tool adapted to insert a cup plug having an inner diameter that is smaller than the circumferential outer diameter of the first section of the collet, such that when the cup plug is placed onto the distal end of the collet the flexible segments are adapted to flex radially inward, reducing the outer diameter of the first section and allowing the distal end of the collet to fit within the inner diameter of the cup plug, wherein the flexible segments are biased to an un-flexed position and push radially outward to provide frictional engagement to secure the cup plug on the distal end of the collet and to allow free release of the cup plug insertion tool from the cup plug after the cup plug has been inserted, and to position the cup plug co-axially with a central axis of the cup plug insertion tool, a tip positioned at the distal end of the collet, the tip adapted to engage a disk portion of a cup plug that is placed thereon, and a chamfer formed between the outer diameter of the first section and the tip, the chamfer adapted to prevent the distal end of the collet from contacting an annular radius of a cup plug placed thereon.

According to another aspect, the collet includes an annular groove formed adjacent the base, the annular groove adapted to allow the flexible segments to flex radially inward, further wherein, the force necessary to flex the flexible segments radially inward is tunable based on a width and depth of the annular groove.

According to another aspect, the cup plug insertion tool further includes a vacuum tube positioned within the inner diameter of the collet, the vacuum tube adapted to engage a cup plug to provide additional force to secure the cup plug onto the distal end of the collet.

According to another aspect, the cup plug insertion tool is made from a metallic material and the collet includes six longitudinal slots defining six flexible segments.

According to several aspects of the present disclosure, a cup plug insertion tool comprises a cylindrical base, and a cylindrical collet extending from the base and including at least two longitudinal slots that divide the collet into at least two flexible segments adapted to flex radially inward under force, an annular groove formed adjacent the base, the annular groove adapted to allow the flexible segments to flex radially inward, further wherein, the force necessary to flex the flexible segments radially inward is tunable based on a width and depth of the annular groove, a first section defining a circumferential outer diameter and a circumferential inner diameter, a second section defining a circumferential outer diameter that is larger than the circumferential outer diameter of the first section, a tip positioned at the distal end of the collet, and a chamfer formed between the outer diameter of the first section and the tip.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
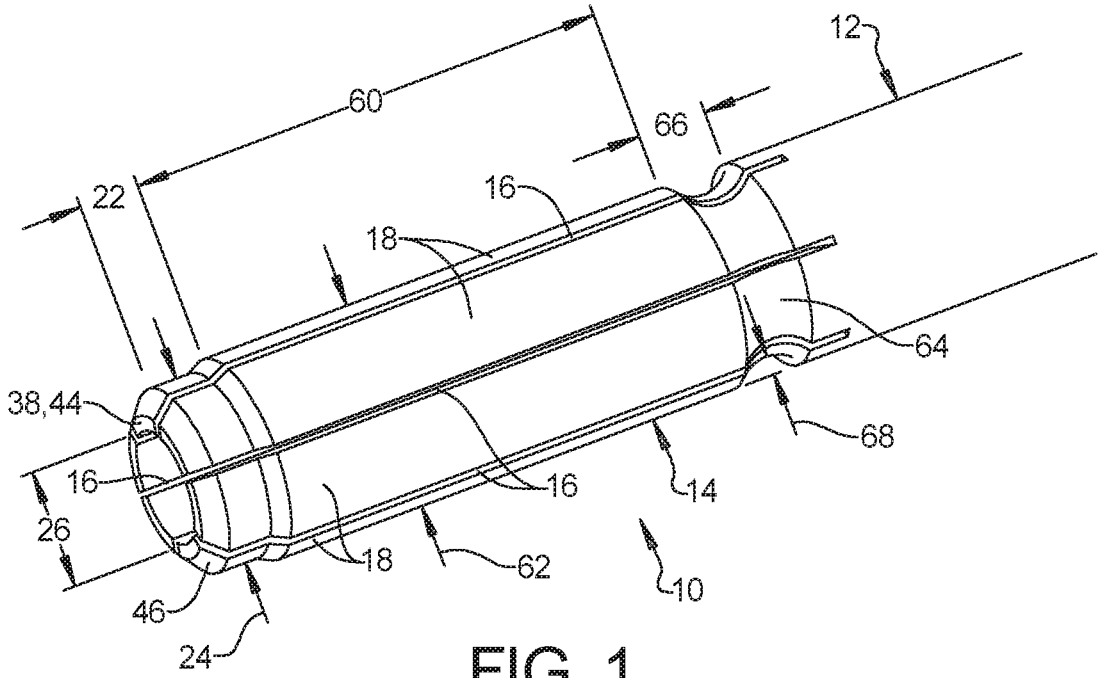
FIG. 1 is a perspective view of a cup plug insertion tool according to an exemplary embodiment.
Figure 2:
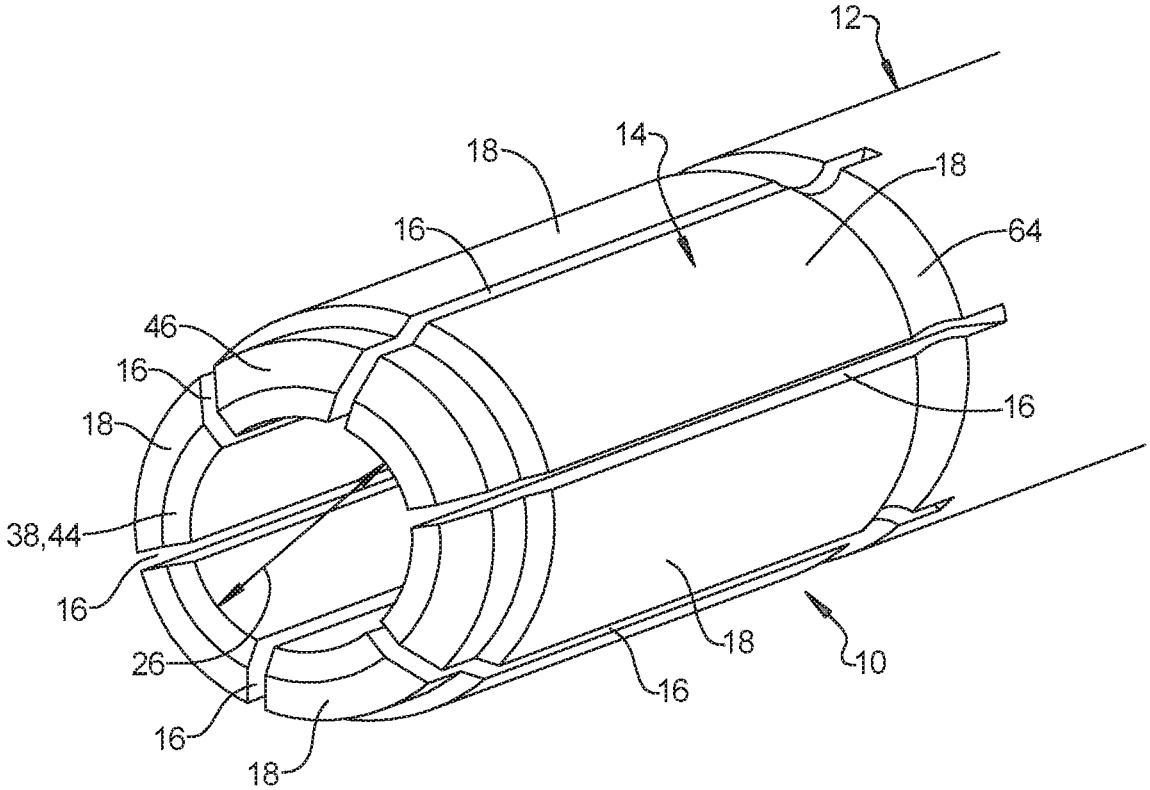
FIG. 2 is a perspective view of a tip of a collet of the cup plug insertion tool shown in FIG. 1.

Referring to FIG. 1 and FIG. 2, a cup plug insertion tool 10 in accordance with the present disclosure includes a cylindrical base 12 and a cylindrical collet 14 extending from the base 12. The collet 14 includes at least two longitudinal slots 16 that divide the collet 14 into at least two flexible segments 18. In the exemplary embodiment shown in FIG. 1 and FIG. 2, the collet 14 includes six longitudinal slots 16 spaced equidistantly around the collet 14 that divide the collet 14 into six identical flexible segments 18.

Figure 3:
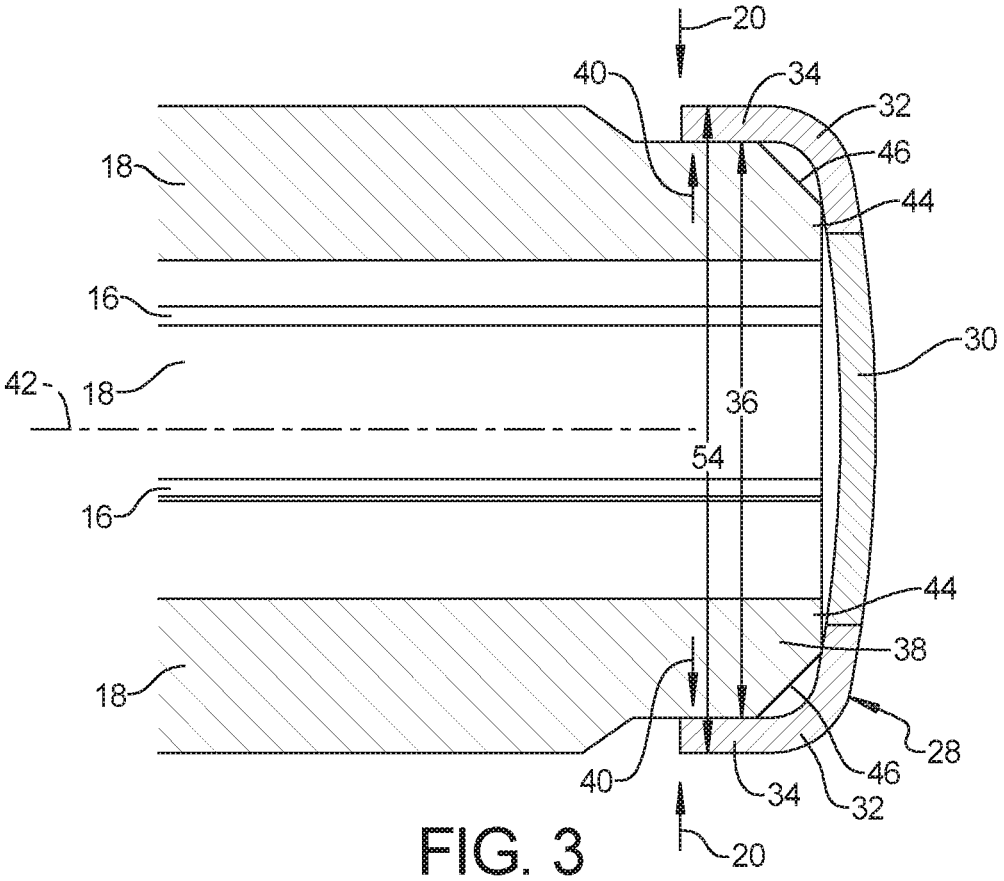
FIG. 3 is a side sectional view of the collet of the cup plug insertion tool shown in FIG. 1 with a cup plug secured thereon.

The flexible segments 18 are adapted to flex radially inward under force, as indicated by arrows 20. The collet 14 includes a first section 22 that defines a circumferential outer diameter 24 and a circumferential inner diameter 26. Referring to FIG. 3, the cup plug insertion tool 10 is adapted to insert a cup plug 28 having a disk portion 30, an annular radius 32 extending around the disk portion 30, and a cylindrical skirt 34 extending longitudinally from the annular radius 32.

The skirt 34 of the cup plug 28 defines an inner diameter 36 that is smaller than the circumferential outer diameter 24 of the first section 22 of the collet 14. When the cup plug 28 is placed onto a distal end 38 of the collet 14 the flexible segments 18 are adapted to flex radially inward, reducing the outer diameter 24 of the first section 22 and allowing the distal end 38 of the collet 14 to fit within the inner diameter 36 of the cup plug skirt 34. The flexible segments 18 are biased to an un-flexed position, such that when inserted within the inner diameter 36 of the cup plug skirt 34, the flexible segments 18 push radially outward, as indicated by arrows 40, to provide frictional engagement between the inner diameter 36 of the cup plug skirt 34 and the cylindrical outer diameter 24 of the first section 22 of the collet 14 to secure the cup plug 28 on the distal end 38 of the collet 14.

Further, the flexible segments 18 provide compliance to prevent the skirt 34 of the cup plug 28 from crimping onto the collet 14 during insertion, thus allowing free release of the cup plug insertion tool 10 from the cup plug 28 after the cup plug 28 has been inserted. The collet 14 is adapted to align a cup plug 28 placed thereon co-axially with a central axis 42 of the cup plug insertion tool 10. In an exemplary embodiment, each of the flexible segments 18 are equally biased to push radially outward with equal force, such that a cup plug 28 placed on the distal end 38 of the collet 14 is automatically centered co-axially with the central axis 42 of the cup plug insertion tool 10.

Referring to FIG. 2, the collet 14 includes a tip 44 positioned at the distal end 38 of the collet 14. The tip 44 provides a cylindrical surface that engages the disk portion 30 of the cup plug 28, as shown in FIG. 3. The collet 14 further includes a chamfer 46 formed between the outer diameter 24 of the first section 22 and the tip 44. The chamfer 46 allows clearance to prevent the distal end 38 of the collet 14 from contacting the annular radius 32 of the cup plug 28.

Figure 4:
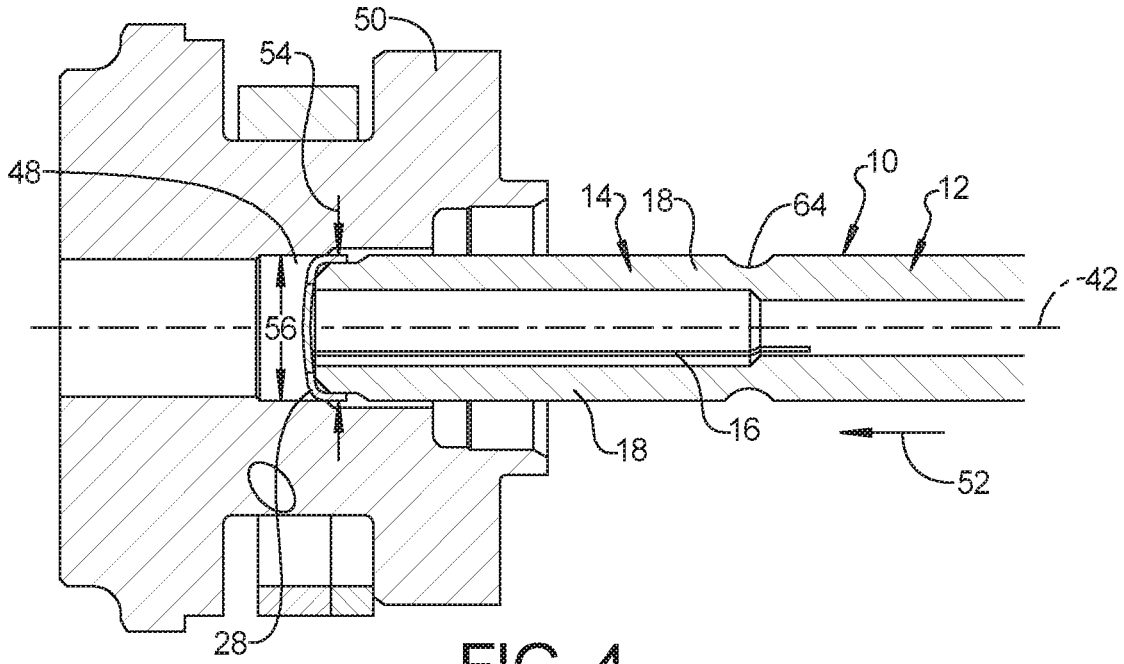
FIG. 4 is a side sectional view illustration showing a cup plug being inserted into a bore of a workpiece using the cup plug insertion tool shown in FIG. 1.

Referring to FIG. 4, when the cup plug insertion tool 10 is used to press a cup plug 28 into a bore 48 formed within a workpiece 50, the flexible segments 18 frictionally engage the inner diameter 36 of the skirt 34 of the cup plug 28 to secure the cup plug 28 onto the cup plug insertion tool 10 and center the cup plug 28 co-axially with the central axis 42 of the cup plug insertion tool 10. Proper centering of the cup plug 28 on the cup plug insertion tool 10 ensures that the cup plug 28 is centered relative to the bore 48 into which the cup plug 28 is being inserted. This minimizes stress concentrations and deformation of the cup plug 28 during insertion, helping to ensure that the cup plug 28 properly seals the bore 48 after insertion.

As the cup plug insertion tool 10 presses the cup plug 28 into place, as indicated by arrow 52, the tip 44 of the collet 14 pushes against the disk portion 30 of the cup plug 28 to push the cup plug 28 into the bore 48. The skirt 34 of the cup plug 28 defines an outer diameter 54 that is larger than an inner diameter 56 of the bore 48 within the workpiece 50. When the cup plug 28 is pressed into the bore 48, there is an interference fit between the outer diameter 54 of the skirt 34 of the cup plug 28 and the inner diameter 56 of the bore 48, creating a seal between the skirt 34 of the cup plug 28 and the bore 48. Because the tip 44 of the collet 14 acts on the disk portion 30 of the cup plug 28, the skirt 34 of the cup plug 28 is pulled into the bore 48, minimizing stress concentrations and deformation of the cup plug 28 during insertion.

Figure 5:
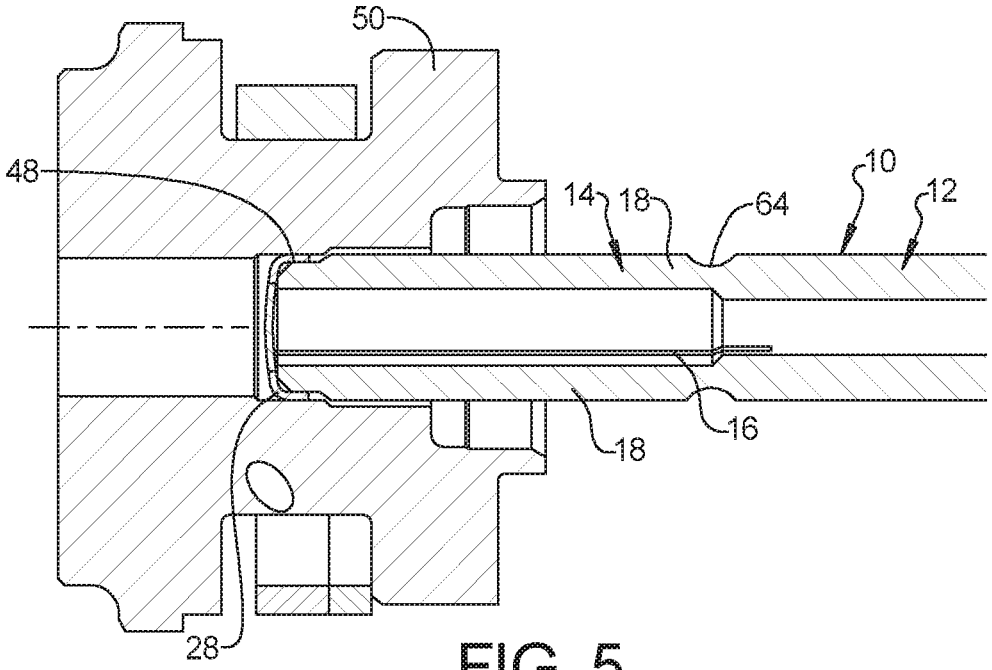
FIG. 5 is the side sectional view shown in FIG. 4, wherein the cup plug has been fully inserted into the workpiece.
Figure 6:
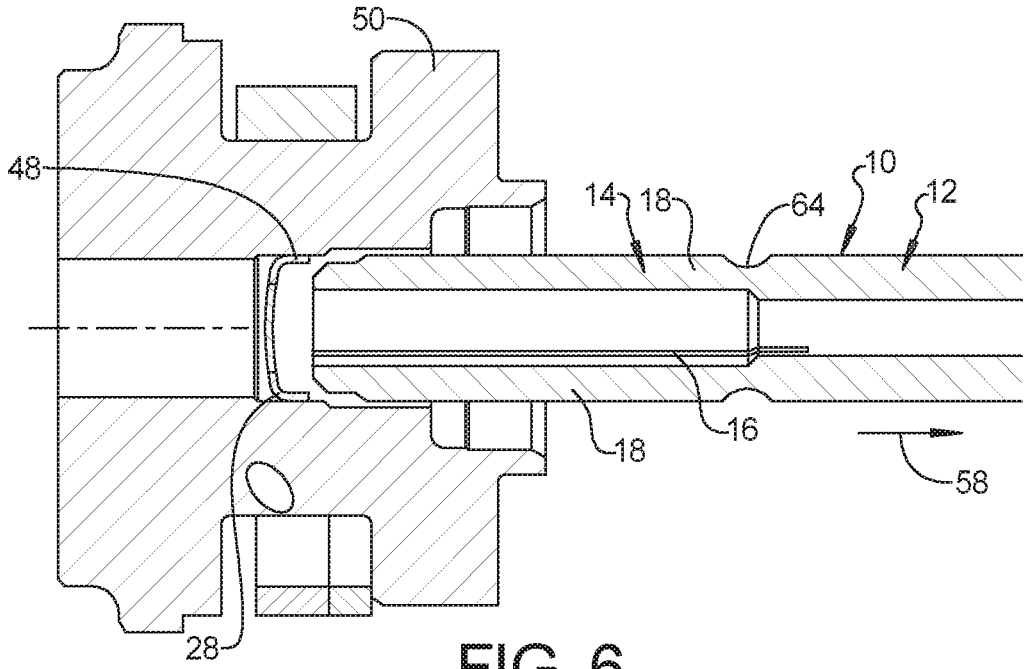
FIG. 6 is the side sectional view shown in FIG. 4, wherein the cup plug insertion tool is being retracted from the bore in the workpiece, leaving the cup plug in place.

Referring to FIG. 5, once the cup plug 28 has been pressed completely into the bore 48 within the workpiece 50, the flexible segments 18 provide compliance to prevent the skirt 34 of the cup plug 28 from crimping onto the first section 22 of the collet 14. When the cup plug insertion tool 10 is retracted, as indicated by arrow 58 in FIG. 6, the first section 22 of the collet 14 freely releases from the cup plug 28. The compliance of the flexible segments 18 prevents the cup plug 28 from crimping onto the collet 14 and being pulled out with the cup plug insertion tool 10 upon retraction.

Referring again to FIG. 1, the collet 14 includes a second section 60 having a cylindrical outer diameter 62 that is larger than the cylindrical outer diameter 24 of the first section 22, and an annular groove 64 formed adjacent to the base 12. The second section 60 of the collet 14 extends longitudinally between the first section 22 and the annular groove 64.

The second section 60 of the collet 14 provides added stiffness to the flexible segments 18. The annular groove 64 defines a flex point to allow the flexible segments 18 to flex radially inward. The amount of biasing force, or flexibility, of the flexible segments 18 is critical to ensuring that the flexible segments 18 secure the cup plug 28 onto the distal end 38 of the collet 14 prior to insertion and also allow the cup plug insertion tool 10 to retract from the cup plug 28 after insertion. The force necessary to flex the flexible segments 18 radially inward, and correspondingly the amount of force with which the flexible segments 18 push radially outward against the cup plug 28, is tunable based on a width 66 and depth 68 of the annular groove 64. Depending on the application, the width 66 and depth 68 of the annular groove 64 are designed to ensure proper flexibility of the flexible segments 18.

Figure 7:
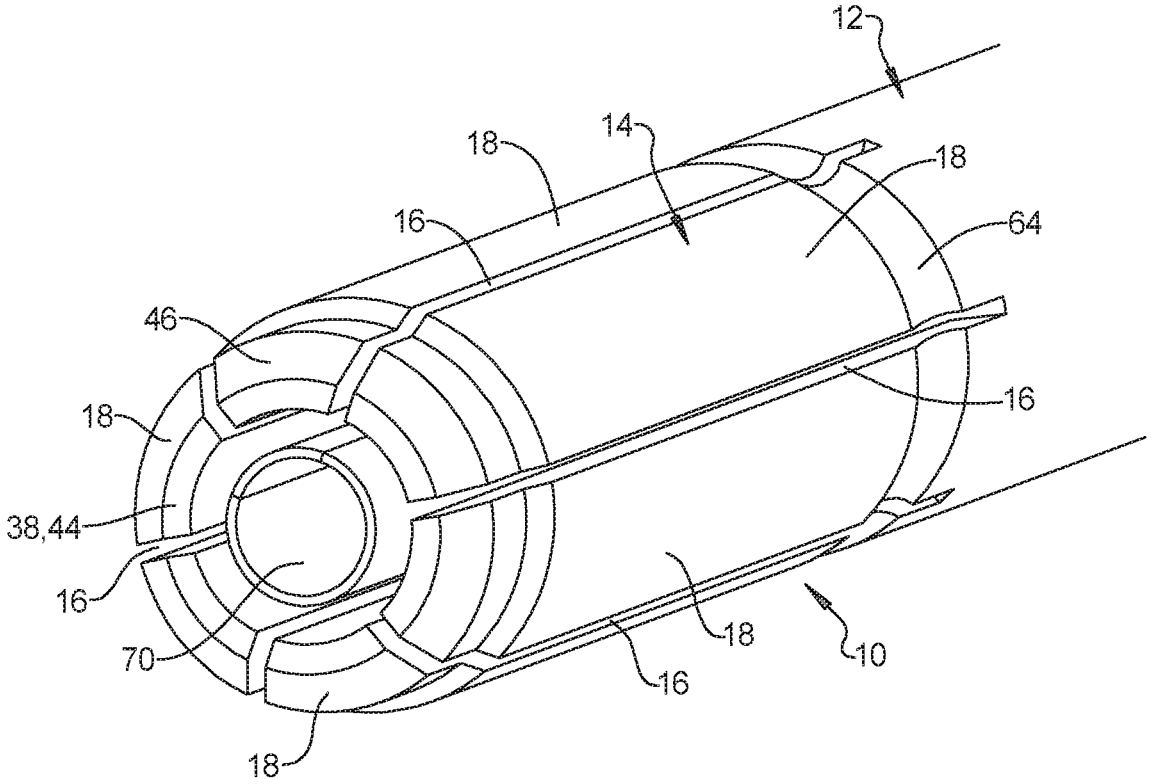
FIG. 7 is a perspective view of an exemplary embodiment including a vacuum tube.

Referring to FIG. 7, in an exemplary embodiment, the cup plug insertion tool 10 includes a vacuum tube 70 positioned within the inner diameter 26 of the collet 14. The vacuum tube 70 is adapted to engage a cup plug 28 to provide additional force to secure the cup plug 28 onto the distal end 38 of the collet 14. A vacuum is applied, via the vacuum tube 70, to the disk portion 30 of the cup plug 28 when the cup plug 28 is placed onto the distal end 38 of the collet 14 providing suction to help secure the cup plug 28 thereon. Once the cup plug 28 has been pressed into place, the vacuum is deactivated, allowing the cup plug insertion tool 10 to be retracted.

The cup plug insertion tool 10 may be made from any suitable material that exhibits characteristics necessary for a particular application. In an exemplary embodiment, the cup plug insertion tool 10 is made from a metallic material, such as, by way of non-limiting examples, steel or aluminum. In many automotive applications, cup plugs 28 are being pressed into steel or aluminum parts, necessitating that the cup plug insertion tool 10 be made from steel or aluminum. In applications requiring low insertion force, or instances where cup plugs 28 and the parts into which the cup plugs 28 are being inserted are made from softer materials, the cup plug insertion tool 10 could be made from a relatively hard polymer material.

A cup plug insertion tool 10 of the present disclosure offers the advantages of ensuring a cup plug 28 is secured on the cup plug insertion tool 10 and centered upon insertion without the risk of the cup plug 28 being pulled out by the cup plug insertion tool 10 upon retraction.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A cup plug insertion tool comprising:

a cylindrical base; and a cylindrical collet extending from the base and including a plurality of longitudinal slots that divide the collet into a plurality of flexible segments;

the collet including a first section defining a circumferential outer diameter and a circumferential inner diameter, wherein the circumferential outer diameter of the first section is adapted to engage a cup plug to removeably secure the cup plug onto a distal end of the collet when the cup plug insertion tool is used to press the cup plug into a bore; and a vacuum tube supported within the inner diameter of the collet and adapted to engage the cup plug to provide additional force to secure the cup plug onto the distal end of the collet.

2. The cup plug insertion tool of claim 1, wherein the flexible segments are adapted to flex radially inward under force, thereby reducing the outer diameter of the first section of the collet.

3. The cup plug insertion tool of claim 2, wherein the cup plug insertion tool is adapted to insert a cup plug having an inner diameter that is smaller than the circumferential outer diameter of the first section of the collet, such that when the cup plug is placed onto the distal end of the collet the flexible segments are adapted to flex radially inward, reducing the outer diameter of the first section and allowing the distal end of the collet to fit within the inner diameter of the cup plug.

4. The cup plug insertion tool of claim 3, wherein the flexible segments are biased to an un-flexed position, and when a cup plug is placed onto the distal end of the collet, the flexible segments push radially outward to frictionally engage the inner diameter of the cup plug and hold the cup plug thereon.

5. The cup plug insertion tool of claim 4, wherein the distal end of the collet is adapted to position the cup plug co-axially with a central axis of the cup plug insertion tool.

6. The cup plug insertion tool of claim 5, wherein each of the flexible segments are equally biased such that a cup plug placed on the distal end of the collet is automatically centered co-axially with the central axis of the cup plug insertion tool.

7. The cup plug insertion tool of claim 5, wherein the biasing force of the flexible segments is adapted to provide frictional engagement to secure a cup plug on the distal end of the collet and to allow free release of the cup plug insertion tool from the cup plug after the cup plug has been inserted.

8. The cup plug insertion tool of claim 7, wherein the distal end of the collet includes a tip adapted to engage a disk portion of a cup plug that is placed thereon, and a chamfer between the outer diameter of the first section and the tip, the chamfer adapted to prevent the distal end of the collet from contacting an annular radius of the cup plug.

9. The cup plug insertion tool of claim 8, wherein the collet includes a second section having a cylindrical outer diameter that is larger than the cylindrical outer diameter of the first section.

10. The cup plug insertion tool of claim 9, wherein the collet includes an annular groove formed adjacent the base, the annular groove adapted to allow the flexible segments to flex radially inward.

11. The cup plug insertion tool of claim 10, wherein the force necessary to flex the flexible segments radially inward is tunable based on a width and depth of the annular groove.

12. The cup plug insertion tool of claim 8, wherein the cup plug insertion tool is made from a metallic material.

13. The cup plug insertion tool of claim 12, wherein the cup plug insertion tool is made from one of steel and aluminum.

14. The cup plug insertion tool of claim 8, wherein the collet includes six longitudinal slots defining six flexible segments.

15. A cup plug insertion tool comprising:

a cylindrical base;

a cylindrical collet extending from the base and including at least two longitudinal slots that divide the collet into at least two flexible segments, the flexible segments adapted to flex radially inward under force, and a first section defining a circumferential outer diameter and a circumferential inner diameter, the cup plug insertion tool adapted to insert a cup plug having an inner diameter that is smaller than the circumferential outer diameter of the first section of the collet, such that when the cup plug is placed onto the distal end of the collet the flexible segments are adapted to flex radially inward, reducing the outer diameter of the first section and allowing the distal end of the collet to fit within the inner diameter of the cup plug, wherein the flexible segments are biased to an un-flexed position and push radially outward to provide frictional engagement to secure the cup plug on the distal end of the collet and to allow free release of the cup plug insertion tool from the cup plug after the cup plug has been inserted, and to position the cup plug co-axially with a central axis of the cup plug insertion tool;

a tip positioned at the distal end of the collet, the tip adapted to engage a disk portion of a cup plug that is placed thereon;

a vacuum tube positioned within the inner diameter of the collet, the vacuum tube adapted to engage a cup plug to provide additional force to secure the cup plug onto the distal end of the collet; and a chamfer formed between the outer diameter of the first section and the tip, the chamfer adapted to prevent the distal end of the collet from contacting an annular radius of a cup plug placed thereon.

16. The cup plug insertion tool of claim 15, wherein the collet includes an annular groove formed adjacent the base, the annular groove adapted to allow the flexible segments to flex radially inward, further wherein, the force necessary to flex the flexible segments radially inward is tunable based on a width and depth of the annular groove.

17. The cup plug insertion tool of claim 15, wherein the cup plug insertion tool is made from a metallic material and the collet includes six longitudinal slots defining six flexible segments.

18. A cup plug insertion tool comprising:

a cylindrical base; and a cylindrical collet extending from the base and including:

at least two longitudinal slots that divide the collet into at least two flexible segments adapted to flex radially inward under force;

an annular groove formed adjacent the base, the annular groove adapted to allow the flexible segments to flex radially inward, further wherein, the force necessary to flex the flexible segments radially inward is tunable based on a width and depth of the annular groove;

a first section defining a circumferential outer diameter and a circumferential inner diameter;

a second section defining a circumferential outer diameter that is larger than the circumferential outer diameter of the first section;

a tip positioned at the distal end of the collet; and a chamfer formed between the outer diameter of the first section and the tip; and a vacuum tube positioned within the inner diameter of the collet, the vacuum tube adapted to engage a cup plug to provide additional force to secure the cup plug onto the distal end of the collet.

* * * * *